US006100228A

United States Patent [19]

Argo et al.

[11] Patent Number: 6,100,228

[45] **Date of Patent: *Aug. 8, 2000**

[54] BLEACHING GEL CLEANER THICKENED WITH AMINE OXIDE, SOAP AND SOLVENT

[75] Inventors: Brian P. Argo, Tracy; Clement K. Choy, Alamo; Aram Garabedian, Jr., Fremont, all of Calif.

[73] Assignee: The Clorox Company, Oakland, Calif.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/474,352

[22] Filed: Jun. 7, 1995

Related U.S. Application Data

[63] Continuation of application No. 08/145,900, Oct. 29, 1993.

[51] Int. Cl.[7] ..... C11D 3/395; C11D 3/48; C11D 9/42; C11D 9/50

[52] U.S. Cl. ..... 510/379; 510/383; 510/389; 510/403

[58] Field of Search ..... 252/98, 102, 104, 252/173, 546, 547; 510/379, 380, 381, 383, 389, 403

[56] References Cited

U.S. PATENT DOCUMENTS

| | | | |
|---|---|---|---|
| Re. 34,065 | 9/1992 | Wainberg | 252/104 |
| 3,684,722 | 8/1972 | Hynam | 252/98 |
| 3,876,551 | 4/1975 | Laufer | 252/98 |
| 3,956,158 | 5/1976 | Donaldson | 252/102 |
| 4,113,645 | 9/1978 | De Simone | 252/98 |
| 4,229,313 | 10/1980 | Joy | 252/98 |
| 4,271,030 | 6/1981 | Brierley | 252/98 |
| 4,287,080 | 9/1981 | Siklosi | 252/104 |
| 4,301,021 | 11/1981 | Breant | 252/98 |
| 4,330,425 | 5/1982 | Boden | 252/187 |
| 4,337,163 | 6/1982 | Schilp | 252/96 |
| 4,342,663 | 8/1982 | Boden | 252/186.3 |
| 4,390,448 | 6/1983 | Boden | 252/187.26 |
| 4,414,128 | 11/1983 | Goffinet | 252/111 |
| 4,474,677 | 10/1984 | Foxlee | 252/98 |
| 4,541,951 | 9/1985 | Hall | 252/522 |
| 4,552,680 | 11/1985 | Hartman | 252/102 |
| 4,585,570 | 4/1986 | Nelson | 252/102 |
| 4,588,514 | 5/1986 | Jones | 252/98 |
| 4,772,411 | 9/1988 | Sprecker | 252/95 |
| 4,789,495 | 12/1988 | Cahall | 252/95 |
| 4,822,515 | 4/1989 | Sprecker | 252/174 |
| 4,839,079 | 6/1989 | Wainberg | 252/104 |
| 4,863,631 | 9/1989 | Sprecker | 252/174 |
| 4,921,627 | 5/1990 | Copeland | 252/99 |
| 4,985,402 | 1/1991 | Narula | 512/6 |
| 4,990,494 | 2/1991 | Narula | 512/6 |
| 5,024,776 | 6/1991 | Kreischer | 252/97 |
| 5,075,025 | 12/1991 | Wainberg | 252/95 |
| 5,089,162 | 2/1992 | Rapisarda | 252/102 |
| 5,143,899 | 9/1992 | Narula | 512/6 |
| 5,185,096 | 2/1993 | Ahmed | 252/99 |
| 5,229,027 | 7/1993 | Ahmed | 252/99 |
| 5,236,614 | 8/1993 | Jacquet | 252/96 |
| 5,236,897 | 8/1993 | Narula | 512/6 |
| 5,279,758 | 1/1994 | Choy | 252/104 |
| 5,693,601 | 12/1997 | Iakovides et al. | 510/191 |
| 5,703,036 | 12/1997 | Iakovides et al. | 510/427 |

FOREIGN PATENT DOCUMENTS

| | | |
|---|---|---|
| 0 030 401 | 6/1981 | European Pat. Off. . |
| 0129980 | 1/1985 | European Pat. Off. . |
| 0145 084 | 6/1985 | European Pat. Off. . |
| 0 233 666 | 8/1987 | European Pat. Off. . |
| 0635 568 | 1/1995 | European Pat. Off. . |
| 1 329 086 | 9/1973 | United Kingdom . |
| 2229 460 | 9/1990 | United Kingdom . |
| 93/08247 | 4/1993 | WIPO . |

*Primary Examiner*—Yogendra Gupta
*Assistant Examiner*—John M Petruncio
*Attorney, Agent, or Firm*—Joel J. Hayashida

[57] ABSTRACT

The invention provides a bleaching gel cleaner and a method for preparing it, said cleaner comprising:

a) an effective amount of a hypochlorite-generating compound;

b) a ternary thickening system which comprises: (i) alkali metal soap; (ii) a hydrotrope selected from the group consisting of trialkylamine oxides, betaines and mixtures thereof; and (iii) a bleach stable solvent, each in amounts appropriate to create a gelled composition;

c) a buffer/electrolyte in an amount effective to stabilize the hypochlorite; and d) the remainder as water.

9 Claims, 1 Drawing Sheet

BLEACHING GEL CLEANER THICKENED WITH AMINE OXIDE, SOAP AND SOLVENT

This is a continuation of Application Ser. No. 08/145,900, filed Oct. 29, 1993.

Continued prosecution application of similarly numbered Ser. No. 08/474,352, filed Jun. 7, 1995, itself a continuation of Ser. No. 08/145,900, filed Oct. 29, 1993, now abandoned.

FIELD OF THE INVENTION

The present invention relates to thickened bleaching gel cleaners containing hypochlorite bleach with improved thickening and bleach stability.

BACKGROUND OF THE INVENTION

Thickened hypochlorite bleach solutions or compositions have long been used in a variety of applications including hard surface cleaning, disinfecting and the like. These compositions are typically provided with increased viscosity for a number of reasons, principally to increase residence time of the composition on non-horizontal surfaces.

Many different examples of thickened hypochlorite bleach compositions have been available from a wide variety of sources for use in hard surface cleaning. For example, Finley et al., European Patent Application EP 373,864 and Prince et al., U.S. Pat. No. 5,130,043, disclosed hypochlorite bleach compositions consisting of polyacrylate thickeners, amine oxide detergent, and optional fatty acid soap and/or a bleach stable synthetic anionic detergent for cleaning hard surfaces such as toilet bowls, bathroom tiles and shower walls. Other prior art references have also described various thickened automatic dish washing liquid compositions using polyacrylates in combination with colloidal thickeners to provide proper rheology and stability in hypochlorite bleach compositions including various adjuncts. Stoddart, U.S. Pat. No. 4,576,728, and Corring, U.S. Pat. No. 4,836,948, are representative of these other prior art references. However, as can be seen from the disclosures of each reference, there must be a polyacrylate thickener present in order to obtain the desired viscosity.

Additionally, other examples of thickened hypochlorite-containing cleansers in the art, which usually are used to suspend abrasives, typically require either a colloidal clay thickener, such as disclosed in Hartman, U.S. Pat. Nos. 3,985,668, 4,005,027 and 4,051,056, a mixture of surfactants, such as disclosed in Jones et al., U.S. Pat. No. 4,352,678, or a stearate soap, such as disclosed in Chapman, U.S. Pat. No. 4,240,919. All of these systems suffer from disadvantages, such as premature hardening in the colloidal clay-thickened systems, or poor phase stability, as in the stearate-thickened systems.

Some references describe the unique phenomena that occurs when certain charge-bearing surfactants, such as quaternary ammonium compounds or betaines, are combined with a source of a counterion. U.S. Pat. Nos. 4,900,467, 5,011,538 and 5,055,219, all issued to Smith (and of common assignment herein), provide exemplary cleaning compositions generally characterized as viscoelastic.

There are a number of somewhat slightly thickened hypochlorite bleaching liquids, such as Citrone, U.S. Pat. No. 4,282,109, Joy, U.S. Pat. No. 4,229,313, Schilp, U.S. Pat. No. 4,337,163, Hynam et al., U.S. Pat. No. 3,684,722, and Vipond, U.S. Pat. No. 4,775,492. Generally, however, each of these references discloses relatively thin liquids having relatively high amounts of surfactants which function as hydrotropic materials. These types of liquid bleaching compositions, because of their lack of body, generally cannot be effectively dosed onto vertical or curved surfaces.

Published European patent applications EP 0336651 and 033652, of common assignment herewith, discloses thickened aqueous cleaning compositions, one of which can contain abrasives, both of which are thickened by the combination of surfactants and aluminum oxide, and both can have certain organic solvents present to assist in cleaning performance. Neither product is a gel. However, polymer-thickened bleach-containing systems need to be packaged in opaque packaging, since ultraviolet wavelength light may accelerate decomposition.

A related application, Choy, U.S. patent application Ser. No. 07/780,360, filed Oct. 22, 1991, now U.S. Pat. No. 5,279,758 of common assignment herewith, discloses a thickened hypochlorite composition in which alkyl ether sulfate surfactant and certain solvents are combined to provide an advantageously thickened liquid cleaner. Yet another beneficially thickened gel cleaner, which used polyacrylate as a thickener, was described in Garabedian et al. (U.S. patent application Ser. No. 08/097,738, filed Jul. 27, 1993, of common assignment herewith). The disclosures of these latter two applications are incorporated herein by reference thereto.

Generally, the prior compositions have performed satisfactorily for their intended purpose. However, there is a need for thickened gel cleaner containing hypochlorite bleach with improved thickening and bleach stability, offering improved characteristics and benefits.

SUMMARY OF THE INVENTION

In one aspect of the invention, the invention provides a bleaching gel cleaner comprising:

a) an effective amount of a hypochlorite-generating compound;

b) a ternary thickening system which comprises: (i) alkali metal soap; (ii) a hydrotrope selected from the group consisting of trialkylamine oxides, betaines and mixtures thereof; and (iii) a bleach stable solvent, each in amounts appropriate to create a gelled composition;

c) a buffer/electrolyte in an amount effective to stabilize the hypochlorite; and d) the remainder as water.

It is therefore an object of this invention to provide a hypochlorite bleach-containing gel cleaner, without significant phase separation.

It is a further object of this invention to provide a hypochlorite bleach-containing gel cleaner which obtains thickening without the need of polymer or inorganic thickeners, such as clay.

It is a still further object of this invention to provide a hypochlorite bleach-containing gel cleaner which has excellent chemical and physical stability.

It is another object of this invention to provide a hypochlorite bleach-containing gel cleaner which attains stable thickening through maintaining a desirable ratio between the surfactants and solvents contained therein.

It is yet another object of this invention to provide a hypochlorite bleach-containing gel cleaner which attains stable thickening through the use of a ternary thickening system.

It is also an object of this invention to provide a hypochlorite bleach-containing gel cleaner which can adhere to vertical or curved surfaces without significant migration.

DETAILED DESCRIPTION OF THE PREFERRED EMBODIMENTS

Figure 1:
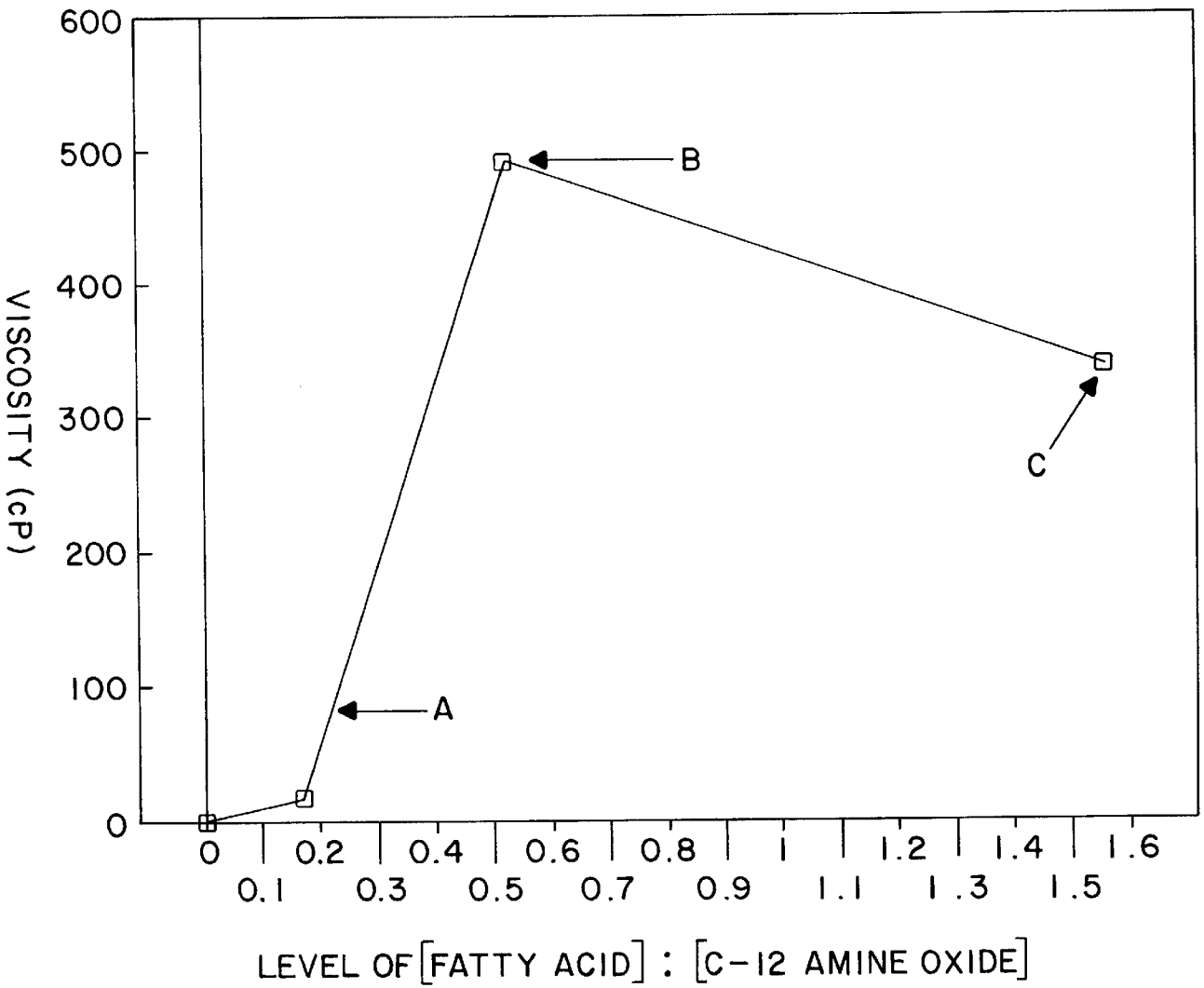
FIG. 1 demonstrates graphically the improved thickening achieved by a proper ratio of amine oxide: soap in one of the preferred embodiments of this invention.

The invention provides a hard surface, hypochlorite-containing, gel cleaner having no significant syneresis, and improved thickening and cleaning performance.

Furthermore, as compared to prior art cleaners which include either polymer or clay-thickened rheologies, or high levels of mixed surfactants, the present invention provides a stable gel cleaner which does not rely on expensive thickening additives and, instead, exploits the viscosity-thickening attributes of the surfactants and solvents used herein, which ordinarily are used purely for their discrete cleaning or aesthetic characteristics. For the purposes of the invention, a gel is a colloid comprising a continuous phase, which is mostly water, in which a dispersed phase, which is the actives, is dispersed in a manner such as to provide a viscous, jelly-like product. The gel is translucent to transparent and may also be opalescent. The gel is a favorable physical state for a hard surface cleaner since it may be dosed or extruded onto a vertical or inclined surface for localized cleaning, e.g., stained bathroom tiles or grout, or the like. Since the gel will be less fluid, or mobile, than a more liquid phase composition, there is little concern with overdosing and spillage. The gel is also an attractive medium for cleaning since it can be colored, or tinted, with, typically, a hypochlorite-bleach stable dye, colorant or pigment. Additionally, the inventive gel cleaners can advantageously be packaged in transparent to translucent packages (e.g., transparent plastic bottles) since ultraviolet wavelength light-mediated degradation does not appear to occur in these non-polymer thickened systems.

In a preferred embodiment, the invention provides a bleaching gel cleaner comprising:

a) an effective amount of a hypochlorite-generating compound;

b) a ternary thickening system which comprises: (i) alkali metal soap; (ii) a hydrotrope selected from the group consisting of trialkylamine oxides, betaines and mixtures thereof; and (iii) a bleach stable solvent, each in amounts appropriate to create a gelled composition;

c) a buffer/electrolyte in an amount effective to stabilize the hypochlorite; and d) the remainder as water.

The individual constituents of the inventive cleaners are described more particularly below. As used herein, all percentages are weight percentages of actives, unless otherwise specified. Additionally, the term "effective amount" means an amount sufficient to accomplish the intended purpose, e.g., thickening, suspending, cleaning, etc.

The formulations of this invention can develop viscosities in the range of 20–5,000 centipoise (cP), preferably 50–2,000 cP, and most preferably 100–1,500 cP. However, because these gels generally have low yield value, they do not suspend abrasives, or other larger size particulate matter, and so such additives are generally avoided.

Hypochlorite Bleach

A hypochlorite-generating compound or bleach source is a principal ingredient. This oxidant chemical provides good stain and soil removal and is additionally a broad spectrum antimicrobial agent. The hypochlorite bleach source may be selected from various hypochlorite-producing species, for example, bleaches selected from the group consisting of the alkali metal and alkaline earth salts of hypohalite, haloamines, haloimines, haloimides and haloamides. All of these are believed to produce hypohalous bleaching species in situ. Hypochlorite and compounds producing hypochlorite in aqueous solution are preferred, although hypobromite may also be suitable. Representative hypochlorite-producing compounds include sodium, potassium, lithium and calcium hypochlorite, chlorinated trisodium phosphate dodecahydrate, potassium and sodium dicholoroisocyanurate and trichlorocyanuric acid. Organic bleach sources suitable for use include heterocyclic N-bromo and N-chloro imides such as trichlorocyanuric and tribromocyanuric acid, dibromo and dichlorocyanuric acid, and potassium and sodium salts thereof, N-brominated and N-chlorinated succinimide, malonimide, phthalimide and naphthalimide. Also potentially suitable are hydantoins, such as dibromo and dichlorodimethylhydantoin, chlorobromodimethylhydantoin, N-chlorosulfamide (haloamide) and chloramine (haloamine). Particularly preferred in this invention is alkali metal hypochlorite, namely, sodium, potassium and lithium hypochlorite, and mixtures thereof.

In this invention, it is possible to use an alkali metal hypochlorite bleach which has a relatively low salt content. For example, hypochlorite bleaches are commonly formed by bubbling chlorine gas through liquid sodium hydroxide or corresponding metal hydroxide to result in formation of the corresponding hypochlorite, along with the co-formation of a salt such as sodium chloride. In other contexts, it has been found desirable to use hypochlorites formed for example by reaction of hypochlorous acid with alkali metal hydroxide in order to produce the corresponding hypochlorite with water as the only substantial by-product. Hypochlorite bleach produced in this manner is referred to as "high purity, high strength" bleach, or also, as "low salt, high purity" bleach, and is available from a number of sources, for example Olin Corporation which produces hypochlorite bleach as a 30% solution in water. The resulting solution could then diluted to produce the hypochlorite strength suitable for use in the present invention.

The hypochlorite may be formed with other alkaline metals as are well known to those skilled in the art. Although the term "hypochlorite" is employed herein, it is not intended to limit the invention only to the use of chloride compounds but is also intended to include other halides or halites, as discussed above.

The hypochlorite and any salt present within the composition can be a source of ionic strength for the composition, although the buffer/electrolyte also plays a significant role. The ionic strength of the composition may also have an effect on thickening.

The hypochlorite is preferably present in an amount ranging from about 0.1 weight percent to about 10 weight percent, more preferably about 0.2% to 5%, and most preferably about 0.5% to 3%.

Ternary Thickening System

As disclosed above, the thickening in the invention is mediated by a ternary system which comprises: (i) alkali metal soap; (ii) a hydrotrope selected from the group consisting of trialkylamine oxides, betaines and mixtures thereof; and (iii) a bleach stable solvent, each in amounts appropriate to create a gelled composition.

1. Alkali Metal Soap

The first component of the ternary thickening system is alkali metal soap (alkyl carboxylates). The soaps utilized are typically formed in situ, by using the appropriate carboxylic acid (e.g., a $C_{6-18}$ carboxylic acid, such as, without limitation, lauric, stearic, myristic acids, and unsaturated acids, such as coco fatty acid), and neutralizing with e.g., sodium hydroxide (NaOH). Other alkali metal hydroxides, such as potassium and lithium hydroxides, can be utilized. Commercial sources of these fatty acids include Henkel Corporation's Emery Division. The soap should be present in an amount of about 0.1 to 10%, more preferably 0.5 to 3% by weight.

It may be possible to add, as a co-surfactant, alkali metal alkyl sulfates, alkyl aryl sulfonates, primary and secondary alkane sulfonates (SAS, also referred to as paraffin sulfonates), alkyl diphenyl ether disulfonates, and mixtures thereof. These latter anionic surfactants will preferably have alkyl groups averaging about 8 to 20 carbon atoms. Further, alkali metal salts of alkyl aryl sulfonic acids might be useful, such as linear alkyl benzene sulfonates, known as LAS's. Typical LAS's have $C_{8-16}$ alkyl groups, examples of which include Stepan Chemical Company's BIOSOFT®, and CALSOFT® manufactured by Pilot Chemical Company. Still further potentially suitable cosurfactants include the alkyl diphenyl ether disulfonates, such as those sold by Dow Chemical Company under the name "Dowfax," e.g., Dowfax 3B2. Other potentially suitable anionic cosurfactants include alkali metal alkyl sulfates such as Conco Sulfate WR, sold by Continental Chemical Company, which has an alkyl group of about 16 carbon atoms; and secondary alkane sulfonates such as HOSTAPUR SAS, manufactured by Farbwerke Hoechst A.G., Frankfurt, Germany.

2. Hydrotropes

In the invention, the most preferred hydrotropes are the amine oxides, especially trialkyl amine oxides, as represented below.

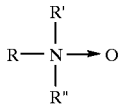

Additionally, it may be suitable to use mono-short chain $C_{1-4}$ alkyl, di-long chain $C_{10-20}$ alkyl amine oxides. In the structure above, R' and R" can be alkyl of 1 to 3 carbon atoms, and are most preferably methyl, and R is alkyl of about 10 to 20 carbon atoms. When R' and R" are both methyl and R is alkyl averaging about 12 carbon atoms, the structure for dimethyldodecylamine oxide, a preferred amine oxide, is obtained. Other preferred amine oxides include the $C_{14}$ alkyl (tetradecyl) and $C_{16}$ (hexadecyl) amine oxides. It is acceptable to use mixtures of any of the foregoing. In general, it has been found that the longer alkyl group results in reduced skin sensitivity, while the shorter alkyl group appears to contribute to better cleaning performance. Representative examples of these particular type of bleach-stable nonionic surfactants include the dimethyldodecylamine oxides sold under the trademarks AMMONYX® LO and CO by Stepan Chemical. Yet other preferred amine oxides are those sold under the trademark BARLOX® by Lonza, Conco XA sold by Continental Chemical Company, AROMAX™ sold by Akzo, and SCHERCAMOX™ sold by Scher Brothers, Inc. These amine oxides preferably have main alkyl chain groups averaging about 10 to 20 carbon atoms.

Betaines and their derivatives, especially $C_{10-20}$ betaines, also appear to be useful hydrotropes in the compositions of the invention. This definition includes both alkylbetaines, sulfoalkylbetaines and mixtures thereof. Particularly preferred are betaines such as those described in the patents to Choy et al., U.S. Pat. Nos. 4,599,186, 4,657,692 and 4,695,394, all of common assignment herewith and the disclosures of which are incorporated herein by reference.

The invention can also beneficially include mixtures of such amine oxides and betaines.

The hydrotrope is present in a range of, generally about 0.1 to 10% by weight, more preferably about 0.5 to 3% by weight.

In a preferred embodiment of this invention, one of the most important aspects of the ternary thickening system is the ratio of the hydrotrope, preferably, amine oxide, to alkali metal soap. In the preferred embodiment, this ratio should be between above at least about 5:1 to 1:1, and most preferably, about 3:1 to 1:1. Here, it is this ratio of hydrotrope to alkali metal soap which is responsible, along with the bleach stable solvent described hereinbelow, for the surprising and advantageous thickening achieved in the gel cleaner, as well as for exemplary bleach (chemical) stability.

3. Bleach-Stable Solvents

Additionally, certain less water soluble or dispersible organic solvents, some of which are advantageously hypochlorite bleach stable, are crucial components of the invention. These solvents will, in cooperation with the alkali metal soap and the hydrotropes described above, provide the thickened gel phase characteristic of the invention. These bleach stable solvents include those commonly used as constituents for proprietary fragrance blends, such as terpene derivatives. The terpene derivatives herein include terpene hydrocarbons with a functional group. Effective terpenes with a functional group include, but are not limited to, tertiary alcohols and ethers. Representative examples for each of the above classes of terpenes with functional groups include but are not limited to the following: Terpene alcohols, including, for example, cis-2-pinanol, pinanol, thymol, 1,8-terpin, dihydro-terpineol, tetrahydromyrcenol, tetrahydrolinalool, and tetrahydro-alloocimenol; and terpene ethers, including, for example, benzyl isoamyl ether, 1,8-cineole, 1,4-cineole, isobornyl methylether, methyl hexylether. Further, other tertiary alcohols are useful herein. Additional useful solvents include alicyclic hydrocarbons, such as methylcyclohexane.

Terpene hydrocarbons with functional groups which appear suitable for use in the present invention are discussed in substantially greater detail by Simonsen and Ross, *The Terpenes,* Volumes I–V, Cambridge University Press, 2nd Ed., 1947 (incorporated herein by reference thereto). See also, co-pending and commonly assigned U.S. patent application Ser. No. 07/780,360, filed Oct. 22, 1991, now U.S. Pat. No. 5,279,758 of Choy, incorporated herein by reference thereto.

In this application, the most preferred solvents are tetrahydromyrcenol, dihydroterpineol, which are tertiary terpene alcohols, and tertiary alcohols, such as benzyl alcohol, dimethyl benzyl carbinol, 2-methyl-2-hexanol.

It is preferred to add about 0.05 to about 5% solvent, more preferably about 0.05 to 3% and most preferably about 0.05 to about 2.5%, of the bleach stable solvent herein. Mixtures of any of the foregoing solvents are also useful herein.

Buffers/Electrolytes pH adjusting agents may be added to adjust the pH, and/or buffers may act to maintain pH. In this instance, alkaline pH is favored for purposes of both rheology and cleaning effectiveness. Additionally, if the cleaner includes a hypochlorite source, a high pH is important for maintaining hypochlorite stability. Examples of buffers include the alkali metal silicates, metasilicates, polysilicates, carbonates, bicarbonates, sesquicarbonates, hydroxides, orthophosphates, metaphosphates, pyrophosphates, polyphosphates and mixtures of the same. Certain organic buffers also appear suitable (although may require an additional ionizable compound), such as polyacrylates, and the like. Control of pH may be necessary to maintain the stability of a hypochlorite source and to avoid protonating the amine oxide.

For the latter purpose, the pH should be maintained above the pKa of the amine oxide. Thus for the hexadecyl dimethyl amine oxide, the pH should be above about 6. Where the active halogen source is sodium hypochlorite, the pH is maintained above about pH 10.5, preferably above or about pH 12. Most preferred for this purpose are the alkali metal hydroxides, especially sodium, potassium, or lithium hydroxide. The total amount of pH adjusting agent/buffer including that inherently present with bleach plus any added, can vary from about 0.1% to 15%, preferably from about 0.1–10%.

Water

It should be briefly noted that the main ingredient in the inventive compositions is water, preferably softened, distilled or deionized water. Water provides the continuous liquid phase into which the other ingredients are added to be dissolved/dispersed. This provides the unique fluid properties of the invention. The amount of water present generally exceeds 30% and, indeed, can be as high as 98%, although generally, it is present in a quantity sufficient (q.s.) to provide the appropriate gel characteristics desired of the invention.

Optional Ingredients

The composition of the present invention can be formulated to include such components as fragrances, coloring agents, whiteners, solvents, chelating agents and builders, which enhance performance, stability or aesthetic appeal of the composition. From about 0.01% to about 0.5% of a fragrance such as those commercially available from International Flavors and Fragrance, Inc. may be included, although it should be noted that many of the solvents described hereinabove may actually perform in place of such fragrances. Dyes and pigments may be included in small amounts. Ultramarine Blue (UMB) and copper phthalocyanines are examples of widely used pigments which may be incorporated in the composition of the present invention.

Experimental

The following Example I illustrates one preferred embodiment of this invention:

Example I

| Ingredient | Wt. % Actives |
|---|---|
| Solvent (tetrahydromyrcenol) | 0.1–0.4% |
| Amine oxide[1] | 1.80 |
| Soap[2] | 1.00 |
| NaOCl | 1.00 |

-continued

Example I

| Ingredient | Wt. % Actives |
|---|---|
| NaOH | 0.8 |
| D.I. $H_2O$ | q.s |
| | 100.00% |

[1]Barlox 12, from Lonza Chemicals. In the Examples following, unless otherwise noted, the identification of the ingredients in these footnotes is the same.
[2]Coco soap, from Emery Division of Henkel Chemicals.

In Example II, a competitive gel cleaner was analyzed and its formulation set forth, and the effect of adding the preferred terpene solvent, tetrahydromyrcenol was observed.

Example II

| Ingredient | Wt. % |
|---|---|
| NaOCl | 0.76 |
| Soap[1] (Na salt) | 1.04 |
| LO amine oxide[2] | 1.76 |
| NaOH | 0.82 |
| $Na_2CO_3$ | 0.08 |
| Silicon | 0.017 |
| Fragrance | present |
| D.I. $H_2O$ | q.s |
| | 100.00% |

[1]The soap is believed to be a stripped coconut fatty acid, with a chain length distribution corresponding to coco fatty acid by Emery Division of Henkel Chemicals, Emery 637.
[2]Believed to be a trimethyl, $C_{12}$ amine oxide, such as sold by Stepan Chemical Company, Ammonyx LO.

To the above formulation in Example II, 0.15% of various solvents were added, to ascertain the co-thickening effect of the preferred solvents:

TABLE I

Solvent Co-Thickening Effects

| Example | Added Solvent | Viscosity |
|---|---|---|
| Base Formulation[1] | — | ~50 cP |
| V | tetrahydromyrcenol | ~490 cP |
| VI | dihydroterpineol | ~250 cP |
| VII | benzyl alcohol | ~100 cP |
| VIII | 3-methyl-2-pentanol | ~100 cP |
| IX | dimethyl benzyl carbinol | ~100 cP |
| X | 2-methyl-2-hexanol | ~90 cP |
| XI | methylcyclohexane | ~80 cP |
| XII | benzyl isoamyl ether | ~70 cP |
| XIII | dimethoxy ethane | ~50 cP |
| XIV | pentane | ~50 cP |
| XV | p-cymene | ~50 cP |

[1]Product of Example II is remade without presence of any fragrance. In each succeeding example, the solvent is added back.

As can be seen from the foregoing data, the addition of 0.15% of the preferred solvents can result in surprisingly advantageous thickening of a bleaching gel. Thus, even though the formulation of Example II is of a competitive cleaner, the addition of the solvents to obtain the thickening of the resulting gel forms a part of this invention.

In the test depicted below in TABLE II, the formulation of Example II and a preferred composition of this invention (Example XVI) were compared for hypochlorite stability. The two formulations were stored at 48.8° C. and measured for remaining hypochlorite level at various intervals. The storage at such elevated temperatures is to simulate longer term storage.

TABLE II

| Hypochlorite Storage Stability | | |
|---|---|---|
| Time (Days) | Example IV | Example XVI[1] |
| 0 | 0.89% | 0.97% |
| 10 | 0.67% | 0.79% |
| 21 | 0.43% | 0.77% |
| 39 | 0.06% | 0.70% |

[1]Example XVI contained 0.15% tetrahydromyrcenol, 1.80% $C_{12}$ amine oxide, 1.00 coco fatty acid soap, 1.00% NaOCl, 0.8% NaOH and the remainder, deionized water.

The composition of Example XVI, a preferred composition, had superior hypochlorite stability over that of Example II, a competitive example (including fragrance).

EXAMPLE XVII

In FIG. 1, the effect of the hydrotrope (amine oxide): fatty acid soap ratio was plotted against changes in viscosity, with viscosity measurements comprising the y-axis and the amine oxide : fatty acid levels comprising the x-axis. Plotted point A represents about 5:1 ratio of amine oxide to soap ratio, while plotted point B represents about 2:1 amine oxide to soap ratio, and finally, plotted point C represents about 1:1 amine oxide to soap ratio. These points demonstrate that a particularly preferred embodiment of the inventive compositions have surprisingly exemplary thickening efficacy and viscosity stability between the ranges of about above a 5:1 ratio amine oxide : soap to about 1:1 ratio amine oxide: soap. All of the plotted points contained 0.15% tetrahydromyrcenol solvent, 1.0% NaOCl.

The above examples have been depicted solely for purposes of exemplification and are not intended to restrict the scope or embodiments of the invention. The invention is further illustrated with reference to the claims which follow hereto.

We claim:

1. A transparent to translucent bleaching gel cleaner consisting essentially of:

a) an effective amount of a hypochlorite-generating compound sufficient to generate about 0.1–10% hypochlorite;

b) a ternary thickening system which comprises: (i) about 0.1–10% alkali metal soap; (ii) about 0.1–10% of a hydrotrope selected from the group consisting of trialkylamine oxides, betaines and mixtures thereof; and (iii) about 0.15–5% of a bleach stable solvent, each in amounts appropriate to create said transparent to translucent gel cleaner, the cleaner having a viscosity of about 250 to 2,000 cps;

wherein said bleach stable solvent is either tetrahydromyrcenol, dihydroterpineol, or a mixture thereof;

c) about 0.1–15% of a buffer/electrolyte to stabilize the hypochlorite, said buffer/electrolyte being alkali metal hydroxide; and d) the remainder as water.

2. The gel cleaner of claim 1 wherein said bleach stable solvent is dihydroterpineol.

3. The gel cleaner of claim 1 wherein said alkali metal soap of b)(i) is a $C_{8-20}$ fatty acid.

4. The gel cleaner of claim 1 wherein said hydrotrope of b)(i) is a trialkyl amine oxide having the structure

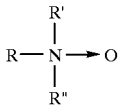

wherein R' and R" are alkyl of 1 to 3 carbon atoms and R is alkyl of 10 to 20 atoms.

5. The gel cleaner of claim 4 wherein R' and R" are both methyl and R is alkyl averaging about 12 carbon atoms.

6. The gel cleaner of claim 5 where R' and R" are both methyl and R is $C_{14}$.

7. The gel cleaner of claim 5 wherein R' and R" are both methyl and R is $C_{16}$.

8. The gel cleaner of claim 1 wherein the hypochlorite of a) is selected from the group consisting of sodium hypochlorite, potassium hypochlorite, lithium hypochlorite, calcium hypochlorite, chlorinated trisodium phosphate dodecahydrate, potassium dichloroisocyanurate, and sodium dichloroisocyanurate; potassium trichlorocyanurate and sodium trichlorocyanurate; trichlorocyanuric acid, dichlorocyanuric acid; potassium dichlorocyanurate and sodium dichlorocyanurate; N-chlorinated succinimide, N-chlorinated malonimide, N-chlorinated phthalimide and N-chlorinated naphthalimide; dichlorodimethylhydantoin, N-chlorosulfamide, and chloramine.

9. The gel cleaner claim 1 wherein the electrolyte/buffer of claim 1 is selected from the group consisting essentially of alkali metal silicates, metasilicates, polysilicates, carbonates, bicarbonates, sesquicarbonates, hydroxides, orthophosphates, metaphosphates, pyrophosphates, polyphosphates, and mixtures thereof.

* * * * *